US006230385B1

(12) United States Patent
Nelson

(10) Patent No.: US 6,230,385 B1
(45) Date of Patent: May 15, 2001

(54) MOLDING AFFIXED WITH WEDGED DIVIDER TRACK

(75) Inventor: Thomas J. Nelson, Belton, TX (US)

(73) Assignee: Premark RWP Holdings, Inc., Wilmington, DE (US)

( * ) Notice: Subject to any disclaimer, the term of this patent is extended or adjusted under 35 U.S.C. 154(b) by 0 days.

(21) Appl. No.: 09/055,890

(22) Filed: Apr. 7, 1998

Related U.S. Application Data

(63) Continuation-in-part of application No. 08/740,809, filed on Nov. 1, 1996, now abandoned.

(51) Int. Cl.[7] ..... B23P 11/02

(52) U.S. Cl. ..... 29/450; 29/525.02; 29/525.03; 29/525.04; 52/461; 52/464; 52/468; 52/472; 403/292; 403/293; 403/298

(58) Field of Search ..... 29/450, 451, 525.02, 29/525.03, 525.04; 52/461, 464, 468, 772; 403/292, 293, 297, 298

(56) References Cited

U.S. PATENT DOCUMENTS

| | | | | |
|---|---|---|---|---|
| 1,430,996 | | 10/1922 | Hörlin . | |
| 2,021,490 | | 11/1935 | Rigandi | 306/33 |
| 2,671,538 | | 3/1954 | Horowitz et al. | 189/34 |
| 2,784,814 | * | 3/1957 | Bright | 189/88 |
| 3,077,012 | | 2/1963 | Speraw | 20/74 |
| 3,264,020 | | 8/1966 | De Ridder | 287/189.36 |
| 3,381,436 | | 5/1968 | Elliott et al. | 52/468 |
| 3,394,526 | * | 7/1968 | Engelbrecht | 52/732 |
| 3,760,547 | * | 9/1973 | Brenneman | 52/586 |
| 4,042,307 | | 8/1977 | Jarvis | 403/290 |
| 4,067,155 | | 1/1978 | Ruff et al. | 52/105 |
| 4,128,983 | * | 12/1978 | Matsubara | 52/731 |

(List continued on next page.)

FOREIGN PATENT DOCUMENTS

| | | | |
|---|---|---|---|
| 00531202 | 9/1954 | (BE) . | |
| 01714532 | 1/1956 | (DE) . | |
| 03635167 | 4/1988 | (DE) . | |
| 9412987 | 10/1994 | (DE) | E04F/15/14 |
| 09401798 | 5/1995 | (DE) | E04F/13/08 |
| 29508050 | 9/1996 | (DE) | E04F/13/08 |
| 00138770 | 4/1985 | (EP) | E06B/1/70 |
| 00696667 | 2/1996 | (EP) | A47G/27/04 |
| 2199600 | 7/1988 | (GB) | E04F/19/02 |
| 02257040 | 1/1993 | (GB) | A47G/27/04 |
| 00519890 | 3/1955 | (IT) . | |

OTHER PUBLICATIONS

Oct. 27, 1999 International Search Report, EP 99 10 6619.
European Search Report Aug. 9, 1999.
"Profiles for Laminate and Parquet" by M.A. Kügele Ges.m.b.h, date unknown, all pages.
National Search Report 9800118–3 dated Jun. 31, 1998.
National Search Report EP 98 10 1193 dated Sep. 9, 1998.

*Primary Examiner*—S. Thomas Hughes
*Assistant Examiner*—Essama Omgba
(74) *Attorney, Agent, or Firm*—Fulbright & Jaworski L.L.P.

(57) ABSTRACT

An elongated wedge shaped spline can be used for joining work pieces in a dovetail joint. It can be used in joining a work piece, such as molding in a dovetailed joint. A divider track having a base support and a pair of spaced apart flanges extending at a right angle from the front surface of the base support is first affixed to a surface. The wedge shaped spline is positioned between and in abutment with the upper portion of the spaced apart flanges. A fan shaped mortise on the back surface of a work piece is positioned over the wedge shaped spline between and abutting the upper portion of the spaced apart flanges. Pressure is applied on the front surface of the work surface of the work piece for seating the work piece on the divider track, thereby forcing the wedge shaped spline between the flanges and spreading the flanges. The spread apart flanges engage the side walls of the fan shaped mortise for joining the work piece in a dovetailed joint with the divider track.

24 Claims, 7 Drawing Sheets

U.S. PATENT DOCUMENTS

| | | | | |
|---|---|---|---|---|
| 4,385,850 | | 5/1983 | Bobath | 403/205 |
| 4,461,131 | | 7/1984 | Pressell | 52/395 |
| 4,648,231 | | 3/1987 | Laroche | 52/775 |
| 4,653,138 | | 3/1987 | Carder | 16/4 |
| 4,701,066 | | 10/1987 | Beam et al. | 403/298 |
| 4,893,449 | * | 1/1990 | Kemper | 52/464 |
| 4,930,279 | | 6/1990 | Bart et al. | 52/466 |
| 5,074,089 | * | 12/1991 | Kemmer et al. | 52/395 |
| 5,155,952 | | 10/1992 | Herwegh et al. | 52/100 |
| 5,706,623 | | 1/1998 | Brown | 52/718.04 |

* cited by examiner

MOLDING AFFIXED WITH WEDGED DIVIDER TRACK

This is a continuation-in-part of U.S. patent application Ser. No. 08/740,809 entitled "MOLDING AFFIXED WITH WEDGED DIVIDER TRACK" filed Nov. 1, 1996, now abandoned.

BACKGROUND OF THE INVENTION

1. Field of the Invention

The present invention relates to the mounting of a workpiece with a wedge shaped spline and a divider track. This wedge shaped spline and installation method is particularly useful in the installation of laminate flooring, moldings, and other decorative items.

2. Description of the Related Art

Commercially available laminate flooring generally includes a wear surface glued to a substrate. The wear surface generally is high wear-resistant decorative laminate. The substrate generally is fiberboard or particle board. Each piece of laminate flooring generally has a groove along one end and one side suitable for joining with a tongue along one side or end of an adjacent piece of laminate flooring. Laminate flooring is commercially installed over a pad.

Aluminum divider tracks are commercially used for the installation of flexible molding, such as vinyl molding. This includes the installation of expansion and transition molding, end caps and reducer strips. Divider tracks are affixed to a floor and a rib on the back of the flexible molding is interlocked between a pair of flanges extending from the front of the divider track. Serrations extending along the rib and the interior surfaces of the flanges interlock for resisting the removal of the rib from the flanges. Molding can be installed by interconnecting it with a divider track without penetrating its decorative front surface with a fastening means or otherwise blemishing it.

There is a need in the installation of molding for securely affixing the molding without blemishing its decorative front surface. In the installation of laminate flooring, there is a need for molding covered with laminate that matches the pattern of the laminate flooring. There is a need for a method for installing laminate covered molding that does not blemish its decorative surface.

SUMMARY OF THE INVENTION

It has now been discovered that an elongated wedge shaped spline can be used for joining work pieces in a dovetail joint. The spline is preferably made of extruded rigid material in the shape of a wedge with one or more serrations extending along one or both of the sloping sides of the wedge for interlocking with one or more serrations extending along one or both of the interior surfaces of flanges extending at right angles from the front surface of a divider track. The wedge shaped spline has sufficient width between its sloping slides for spreading the flanges as the wedge shaped spline is forced between the flanges. The wedge shaped spline is wider at its top than at its bottom and can have sides that slope inwardly at an angle of about 2–8 degrees, preferably 2–5 degrees and more preferably about 2.5 degrees.

The wedge shaped spline of this invention can be used in joining a work piece, such as molding, in a dovetailed joint. A divider track having a base support and a pair of spaced apart flanges extending at a right angle from the front surface of the base support is first affixed to a surface. The wedge shaped spline is positioned between and in abutment with the terminal upper portion of the spaced apart flanges. A fan shaped mortise on the back surface of a work piece is positioned over the wedge shaped spline between and abutting the upper portion of the spaced apart flanges. Pressure is applied on the front surface of the work piece for seating the work piece on the divider track, thereby forcing the wedge shaped spline between the flanges and spreading the flanges. The spread apart flanges engage the side walls of the fan shaped mortise for joining the work piece in a dovetailed joint with the divider track.

One or more serrations can extend along the lower portion of one or both of the sides of the wedge shaped spline for interlocking with one or more serrations along the upper portion of the interior upper surface of one or both of the flanges without substantially spreading them for positioning (or staging) the spline in the divider track as the fan-shaped mortise on the back surface of expansion molding is positioned over the wedge shaped spline.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
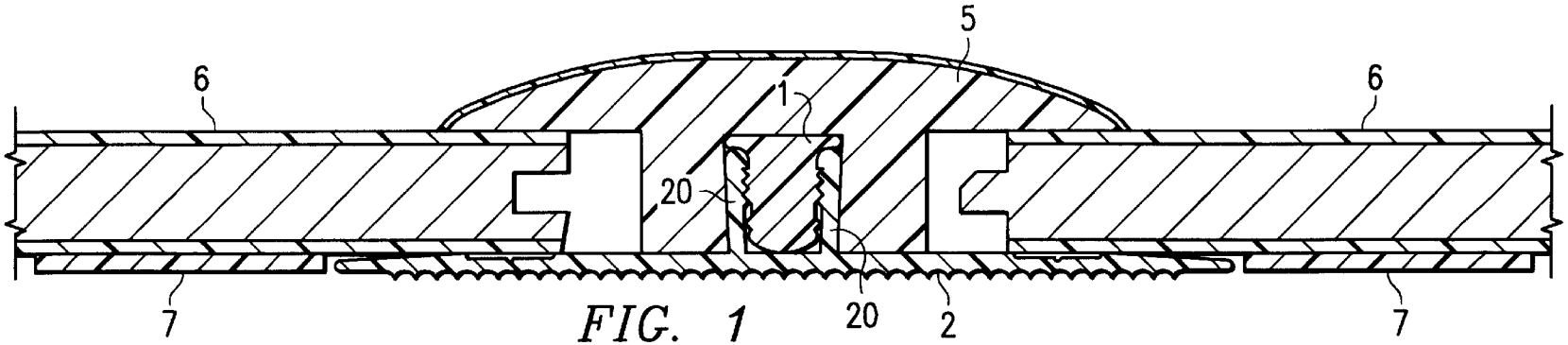
FIGS. 1, 2, and 3 are cross section views of a wedge shaped spline of the present invention used in the installation of an expansion joint between sections of laminate flooring.
Figure 2:
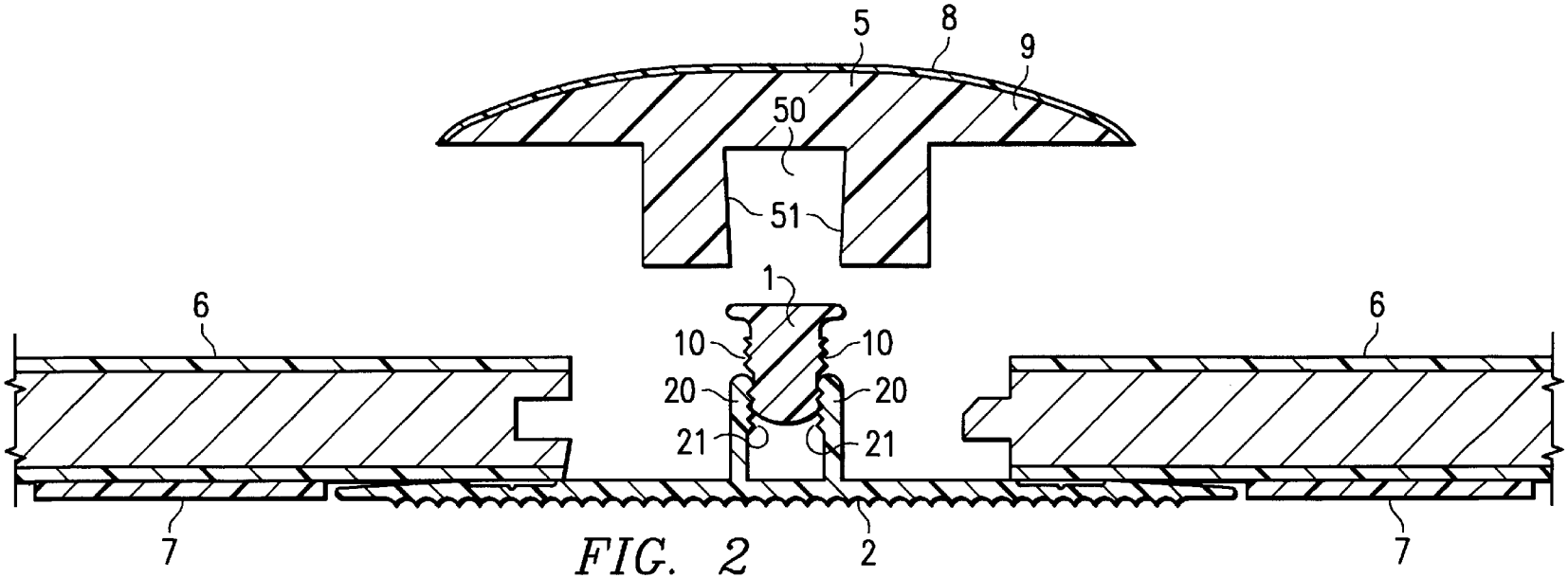
Figure 3:
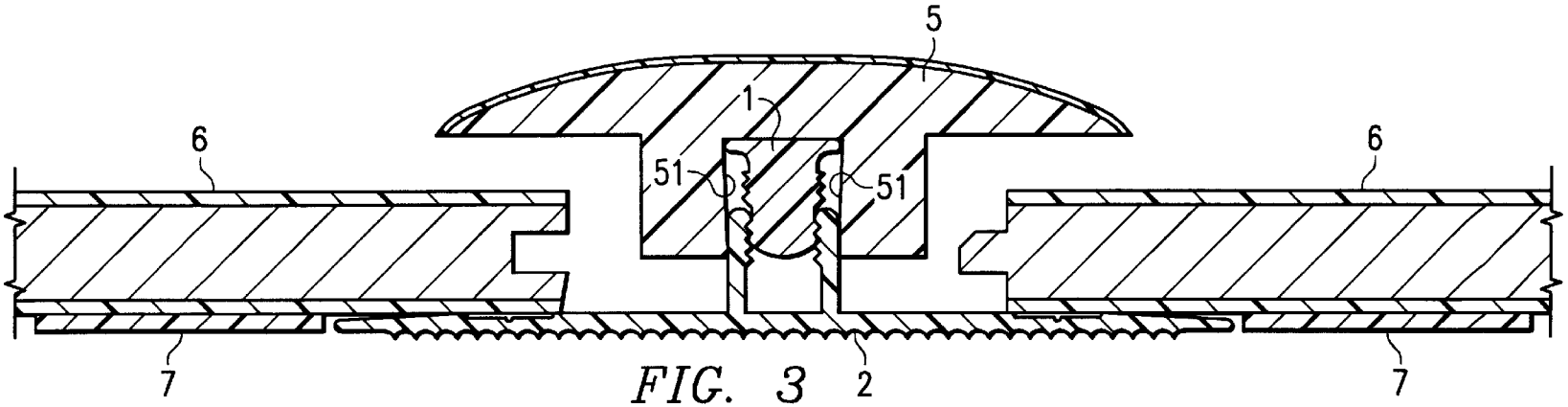

The use of one embodiment of wedge shaped spline (1) of this invention for installing expansion molding (5) for laminate flooring (6) is shown in FIGS. 1–3. The embodiment of wedge shaped spline (1) of the embodiment shown has spread the flanges (20) on a divider track (2), preferably made of aluminum, for securely interconnecting the molding and divider track with a dovetail joint, FIG. 1. Laminate flooring (6) is generally installed over a pad (7).

The expansion molding (5) shown in FIGS. 1–3, 6, and 8 is laminate (8) wrapped fiberboard (9). Laminate can be bonded to other substrates, such as particle board, wood or extruded plastic, for making molding or other work pieces. This expansion molding has a fan-shaped mortise (50) on its planar back side. This fan-shaped mortise (50) has side walls that extend at an acute angle from a planar back surface of the expansion molding (5) for making a fan-shaped mortise (50) with its bottom being wider than the opening of the mortise at its top.

A pair of preferred flanges (20) extend at right angles from the front planar surface of an elongated aluminum divider track (2), FIGS. 1–6 and 9. One or more serrations (21) extend along the interior upper surfaces of the flanges (20). One or more serrations (10) also extend along the sides of the elongated wedge shaped spline (1).

Figure 4:
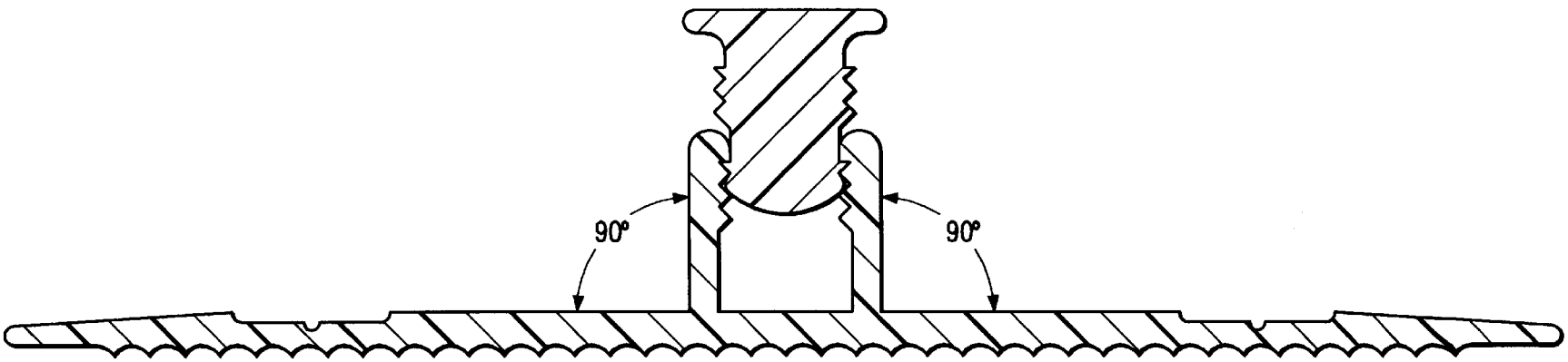
FIGS. 4 and 5 are cross section views of serrations on a wedge shaped spline of the present invention interconnected with serrations on flanges of a divider track and the separation of the flanges as the spline is forced between the flanges.
Figure 5:
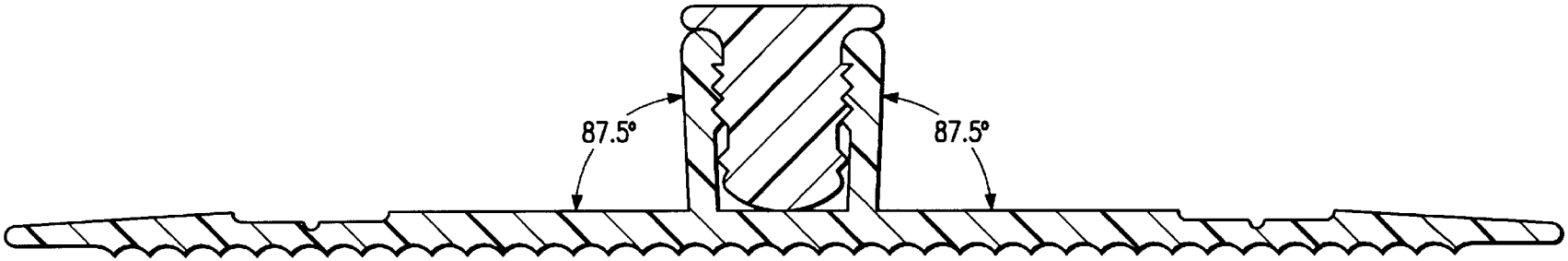
Figure 6:
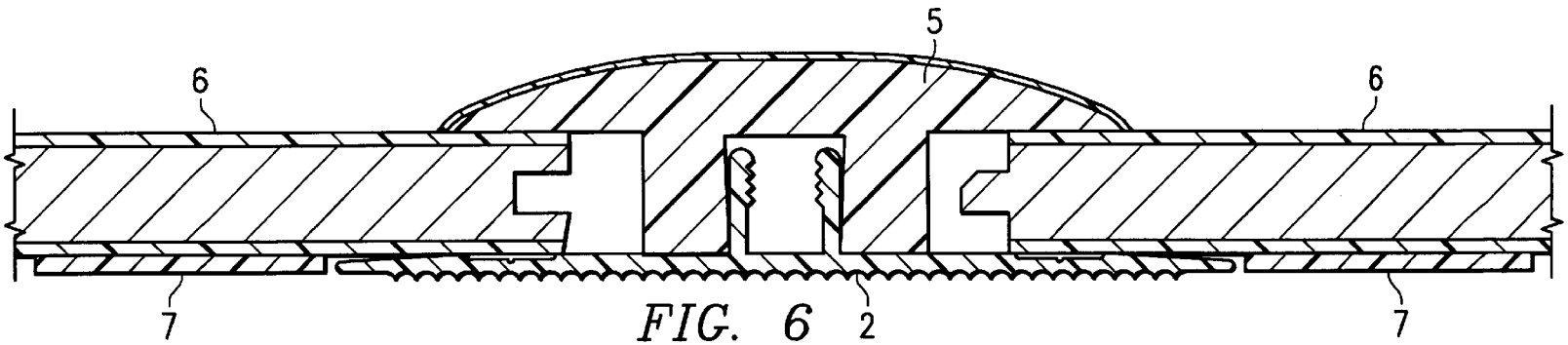
FIG. 6 shows the positioning of the molding over the divider track flanges in conjunction with connecting two sections of laminate flooring, as a means for determining fit between the molding and the divider track flanges.

Serrations (10) along the lower portion of the sides of the wedge shaped spline (1) are shown as being interconnected with serrations (21) along the upper portion of the interior upper surfaces of the flanges (20) without substantially spreading them, FIGS. 2 and 4. This interconnection holds the spline in the divider track as the fan-shaped mortise (50) on the back surface of expansion molding (5) is positioned over the wedge shaped spline (1). This position is a staging position to ready the spline/flange assembly for receiving a workpiece such as molding (5).

The top of wedge shaped spline (1) of this invention is shown in FIG. 3 in contact with the bottom surface of the fan shaped mortise (50). As the expansion molding (5) is seated on the divider track (2), the wedge shaped spline (1) is forced between the flanges (20), spreading them outwardly toward the side walls of the fan-shaped mortise, FIGS. 1, 3, 4 and 5. This joins the expansion molding (5) and divider track (2) with a dovetail shaped joint. The use of a dovetailed joint is considered as a very secure method of joining work pieces. However, conventional dovetail joints must be formed by having the work pieces approach one another at an angle, to allow the joint pieces to fit one into the other. The present invention provides a dovetail joint that is formed "in situ" by joining the work pieces head-on.

In the installation of expansion molding with the wedge shaped spline of this invention, the divider track (2) is first installed and the molding (5) is cut. Before positioning the wedge shaped spline in the divider track, the molding can be seated on the divider track for checking the fit of the molding, FIG. 6.

The elongated wedge shaped spline of this invention and the divider track shown in the figures illustrating this invention can be made by extrusion molding metal, preferably aluminum, or rigid synthetic resin. The selection of suitable materials, methods and equipment of extrusion molding is known to those skilled in the art of making extruded molding.

Figure 7:
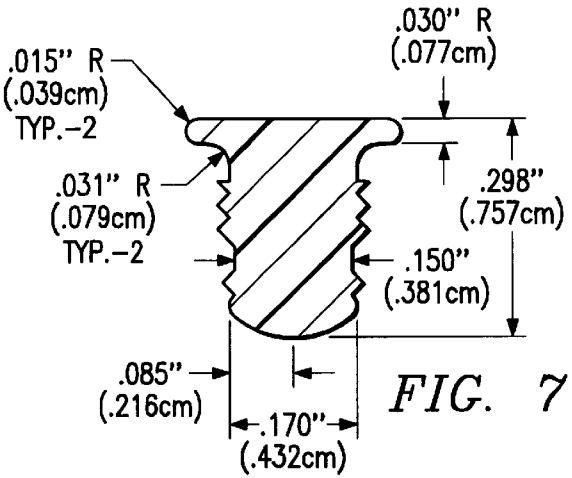
FIG. 7 show the Metric and English dimensions of a specific embodiment of the elongated, wedge shaped spline of this invention.
Figure 8:
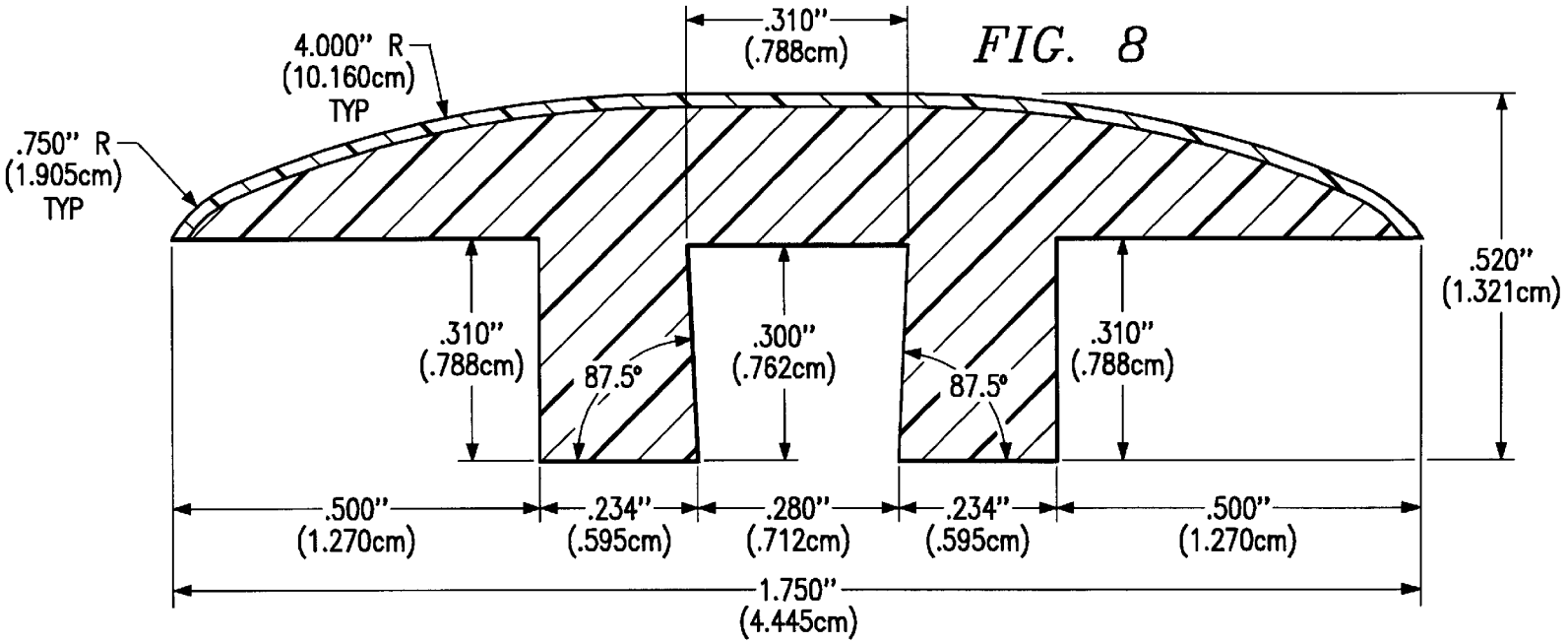
FIGS. 8 and 9 show the Metric and English dimensions of a specific embodiment of expansion molding and divider track that can be installed with the embodiment of a wedge shaped spline shown in FIG. 7.
Figure 9:
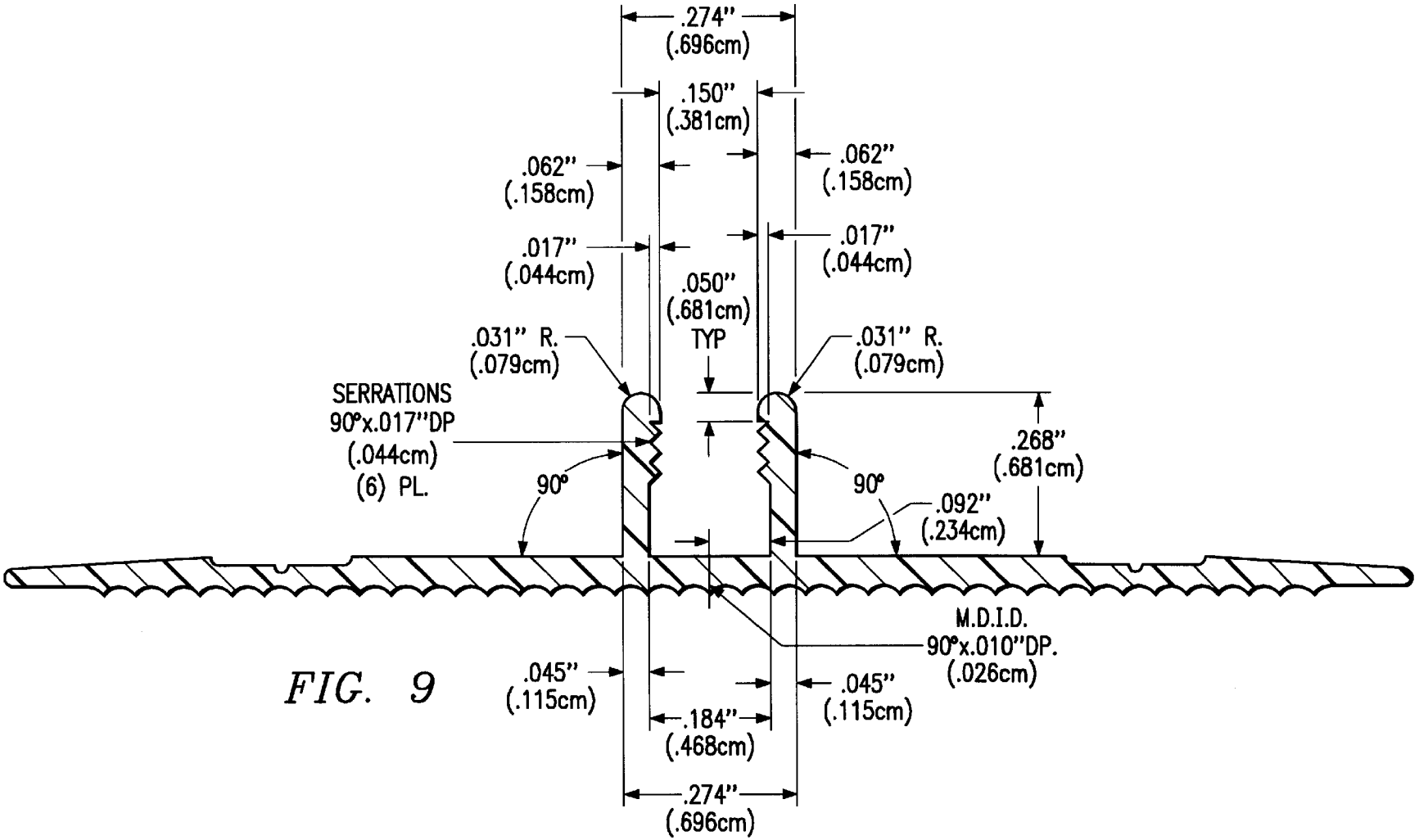

A specific embodiment of the elongated, wedge shaped spline of this invention is shown in FIG. 7. This embodiment of the wedge shaped spline of this invention can be used for the installation of elongated expansion molding shown in FIG. 8 with an elongated divider track as shown in FIG. 9. Dimensions shown on FIGS. 7–9 are in inches and centimeters.

The wedge shaped spline of this invention is wider at its top than at its bottom. In a preferred embodiment of this invention, the sides slope inwardly at an angle of about 2–8 degrees, more preferably 2–5 degrees and most preferably at an angle of about 2.5 degrees. The wedge shaped spline of this invention is shaped and sized for spreading flanges on a divider track into engagement with the side walls of a mortise in a work piece. Excess pressure on the walls of the mortise could damage the work piece.

Figure 10:
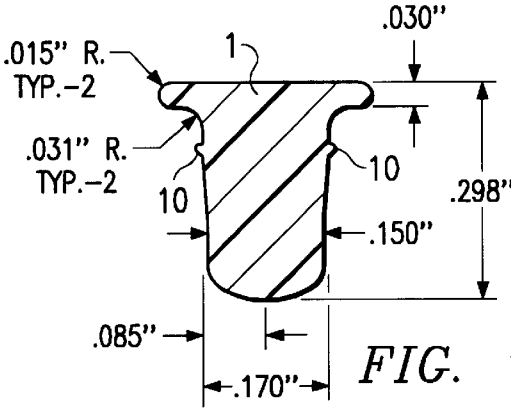
FIG. 10 shows a cross section of a wedge shaped spline of a further preferred embodiment of the present invention having one serration on each side of the wedge shaped spline.

In a further preferred embodiment of the present invention, the wedge shaped spline (1) shown in cross section in FIG. 10, has only one serration (10) on each side of the wedge shaped spline (1). The single serration (10) is provided at a position above the midpoint of each side (nearest the wide end) of the wedge shaped spline (1). This simplified embodiment of spline (1) is easy to extrude, either from metal or rigid synthetic resin. It is most preferred, in this embodiment as well as other embodiments of the spline (1) of the present invention, that the spline be made from a rigid synthetic resin. Suitable rigid synthetic resins include, but are not limited to, polyvinyl chloride, polyolefin, polystyrenes, as well as copolymers such as ABS, HIPS, etc., so long as the resin is extrudable. A further requirement of the resin is that it must provide sufficient rigidity to each serration (10) such that the serration (10) is not destroyed during the steps of staging and installing the workpiece. The synthetic resin also must have sufficient structural integrity so as not to crush and deform upon application of the workpiece to the spline/flange staged structure, but must be able to force the flanges outward to form the dovetail joint with the fan shaped portion (50) of the workpiece, such as in molding (5).

In a preferred embodiment, the spline is prepared from commingled or singular recycled plastics that have been extruded into the spline shape. In a further preferred embodiment the spline is provided as short spline sections of up to about 2–5 inches in length, wherein a plurality of spline sections are inserted along an extended flange assembly to act effectively as "nailing points" along the flange assembly, without the need for nails or other intrusions into the workpiece upon installation. In this embodiment the plurality of spine section are staged along the flange assembly. The workpiece is then placed over the staged spline and pushed into place over the flanges as described above to generate the dovetail joint. In this manner less spline material is needed for a particular length of workpiece. This also provides the ability to remove the workpieces even though this generally destroys the workpiece and spline. The flanges will remain in place with unused portions located between the previous spline locations. Hence, new lengths of spline can be staged in the unused areas of flange and a new workpiece installed.

Figure 11:
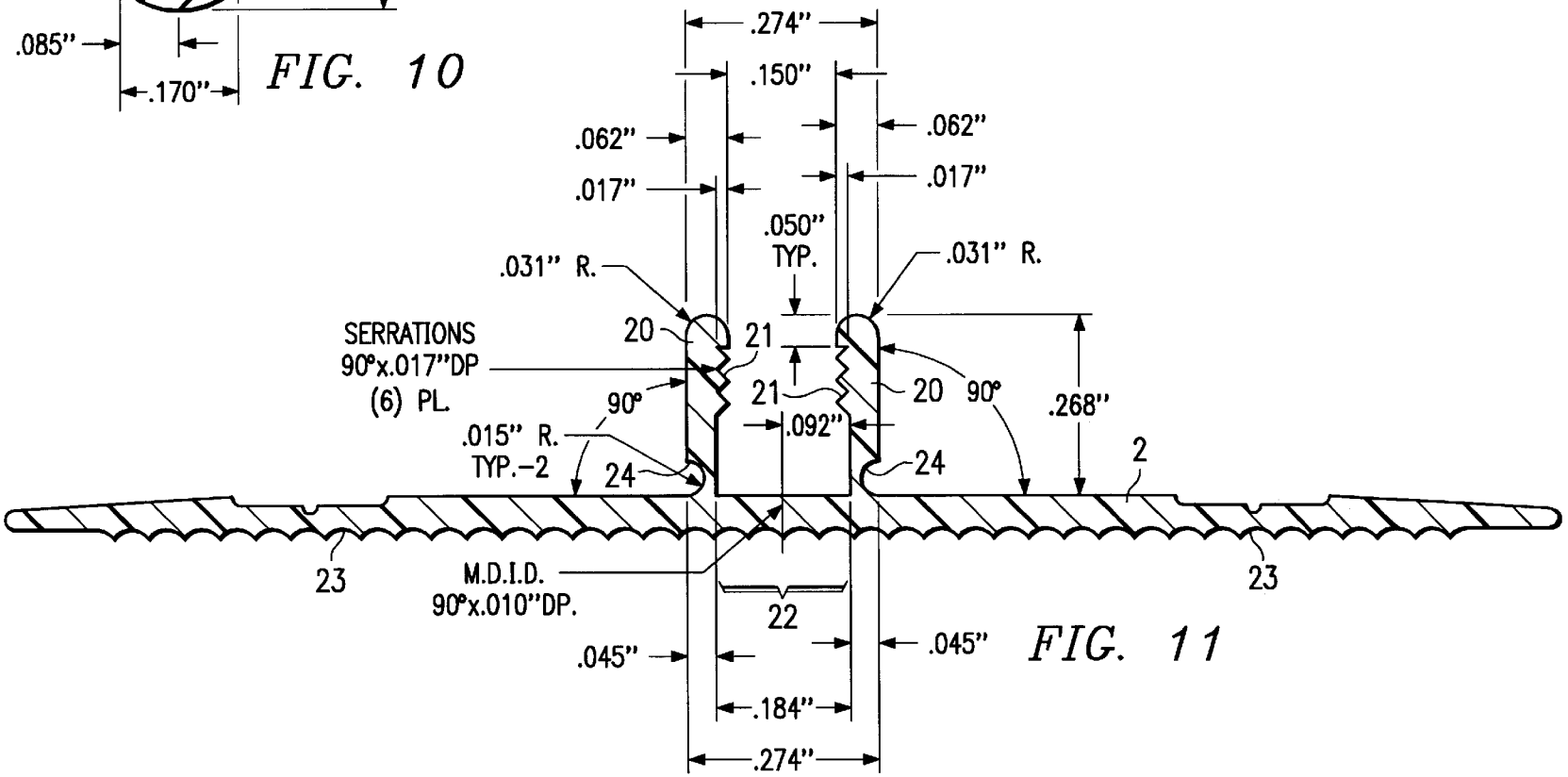
FIG. 11 shows a cross section of a pair of flanges of a preferred embodiment of the present invention having relief notches on the outside surface at the base of each flange and serrations along inner surfaces of each flange.

The preferred spline (1) of FIG. 10 can be used with flanges such as those in FIGS. 1–6 and 9 or can be used with a preferred embodiment of flange (20) as shown in FIG. 11.

The flange (20) of the present invention has one or more serrations (21), preferably a plurality, along inner surfaces of each flange in the pair. The plurality of serrations provide for initial staging of the wedge shaped spline described above and further preferably provides an audible signal that the workpiece has been properly and completely seated by generating a ratcheting sound as the spline travels down the inner surfaces of the pair of flanges, spreading the pair of flanges.

Figure 12:
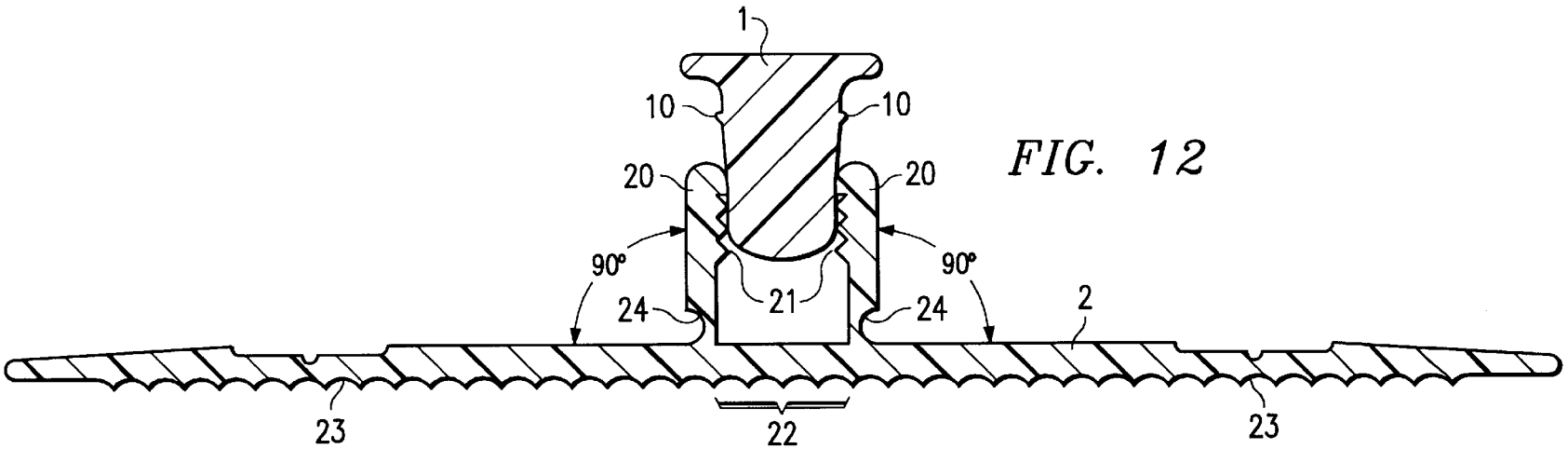
FIG. 12 shows a preferred embodiment of a wedge shaped spline at a staging position in a preferred embodiment of the present invention.
Figure 13:
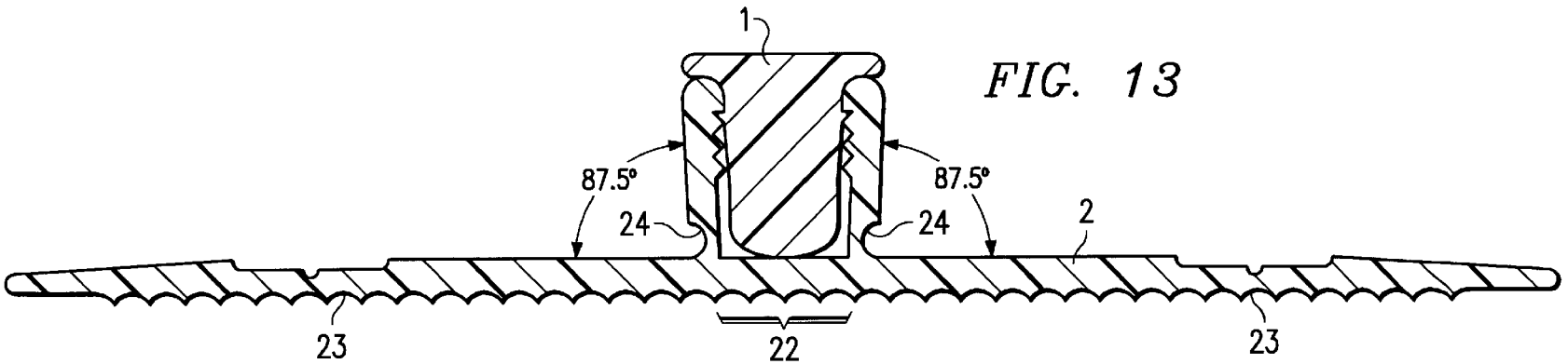
FIG. 13 shows the preferred wedge shaped spline of FIG. 10 in place with the preferred flange of FIG. 11.

The flanges are preferably made of extruded metal, most preferably of aluminum. However, any rigid shapable material could be used in preparing the flanges, such as rigid synthetic resins. The flanges are attached to a base support (22) as shown in FIGS. 11, 12 and 13. The flange assembly (combining two flanges and the base support) can be used as is or can further comprise one or two foot assemblies (23) coplanar with the base support (22) and extending on the outside of one or both flanges as shown in FIGS. 11, 12 and 13. When used without these foot assemblies, the flange assembly can be attached to a surface by using a mounting means that extends through the base support, such as a screw or rivet, so long as the mounting means leaves the inner surface of the base support (between the two flanges) relatively smooth (does not extend significantly above the surface of the base support). This allows for the spline (1) to fully insert into the flange assembly.

When one or two foot assemblies are present, the mounting means can be used on the foot assemblies outside the spline/flange assembly. Preferably the upper surface of the foot assemblies is also relatively smooth to provide a close fit with the contacting surface of the workpiece.

Alternatively, the flange assembly, with or without foot assemblies can be mounted using a suitable conventional adhesive.

In a most preferred embodiment, the flanges preferably have a notch (24) cut in the outside surface in proximity to the intersection of the base support and the bottom of the flange, such that upon insertion of spline (1), less force is needed to force the flange apart than without the notch. This allows for the installation of the workpiece with minimal force, such as by manual pressure, allowing the installer to avoid marring a decorative surface of the workpiece.

The dovetail joint formed by the workpiece spline/flange assembly of the present invention provides an easy, quick and convenient way to install a variety of workpieces, particularly decorative workpieces. For example, the work piece can be a laminate flooring product, edging, moldings such as decorative chair railing, or any other material that must be mounted on a surface without damaging the surface of the workpiece that is exposed after installation.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto to be limited to the examples and descriptions set forth herein but rather that the claims be construed as encompassing all the features of patentable novelty that reside in the present invention, including all features that would be treated as equivalents thereof by those skilled in the art to which this invention pertains.

What is claimed is:

1. A method of joining a work piece in a dovetailed joint, comprising;

affixing a divider track to a surface, wherein said divider track has a base support and a pair of spaced apart flanges extending at a right angle from a front surface of the base support, positioning a wedge shaped spline between and abutting a terminal upper portion of the spaced apart flanges, positioning a fan shaped mortise, located on a back surface of the work piece, over the wedge shaped spline, with the terminal wedge shape spline located between and abutting the upper portion of the spaced apart flanges, and applying pressure on a front surface of the work piece for seating the work piece on the divider track, thereby forcing the wedge shaped spline between the flanges and spreading the flanges, the spread apart flanges engaging side walls of the fan shaped mortise for joining the work piece in the dovetailed joint with the divider track.

2. The method of claim 1, wherein one or more serrations along a lower portion of one or both sides of the wedge shaped spline are interlocked with one or more serrations along an upper portion of one or both interior upper surfaces of the flanges without substantially spreading the flanges, for positioning the spline in the divider track as the fan-shaped mortise on the back surface of expansion molding is positioned over the wedge shaped spline.

3. The method of claim 1, wherein one or more serrations extend along one or both interior upper surfaces of the flanges and along one or both sides of the elongated wedge shaped spline for interlocking the spline between the flanges.

4. The method of claim 1, wherein the wedge shaped spline is wider at its top than at its bottom and its sides slope inwardly from top to bottom at an angle of about 2–5 degrees.

5. The method of claim 1, wherein the wedge shaped spline is wider at its top than at its bottom and its sides slope inwardly from top to bottom at an angle of about 2.5 degrees.

6. The method of claim 1, wherein the fan shaped mortise has side walls that extend at an acute angle from a planar back surface of the work piece for making the fan-shaped mortise with its bottom being wider than the opening to the mortise at its top.

7. The method of claim 1, wherein each of said pair of spaced apart flanges has a relief cutout on an outside surface at an intersection between said flange and said base support.

8. The method of claim 1, wherein said divider track is made of metal.

9. The method of claim 1, wherein said metal is aluminum.

10. The method of claim 1, wherein said divider track further comprises one or more foot assemblies coplanar with said base support and extending on one or both sides of said flanges.

11. A method of joining a molding in a dovetailed joint, comprising;

affixing a divider track to a surface, wherein the divider track has a base support and a pair of spaced apart flanges extending at a right angle from a front surface of the base support, positioning a wedge shaped spline between and abutting a terminal upper portion of the spaced apart flanges, positioning a fan shaped mortise, located on a back surface of the molding, over the wedge shaped spline, with the terminal wedge shape spline located between and abutting the upper portion of the spaced apart flanges, and applying pressure on a front surface of the molding for seating the molding on the divider track, thereby forcing the wedge shaped spline between the flanges and spreading the flanges, the spread apart flanges engaging side walls of the fan shaped mortise for joining the molding in the dovetailed joint with the divider track.

12. The method of claim 11, wherein one or more serrations along a lower portion of one or both sides of the wedge shaped spline are interlocked with one or more serrations along an upper portion of one or both interior upper surfaces of the flanges, without substantially spreading the flanges, for positioning the spline in the divider track as the fan-shaped mortise on the back surface of the molding is positioned over the wedge shaped spline.

13. The method of claim 11, wherein one or more serrations extend along one or both interior upper surfaces of the flanges and along ne or both sides of the elongated wedge shaped spline for interlocking the spline between the flanges.

14. The method of claim 11, wherein the wedge shaped spline is wider at its top than at its bottom and its sides slope inwardly from top to bottom at an angle of about 2–5 degrees.

15. The method of claim 11, wherein the wedge shaped spline is wider at its top than at its bottom and its sides slope inwardly from top to bottom at an angle of about 2.5 degrees.

16. The method of claim 11, wherein the fan shaped mortise has side walls that extend at an acute angle from a planar back surface of the molding for making the fan-shaped mortise with its bottom being wider than the opening to the mortise at its top.

17. The method of claim 11, wherein the molding is laminate wrapped fiberboard.

18. The method of claim 11, wherein the molding is laminate wrapped particle board, wood or extruded plastic.

19. The method of claim 11, wherein the molding has a fan shaped mortise on its planar back side.

20. The method of claim 11, wherein each of said pair of flanges has a relief cutout on an outside surface at an intersection between said flange and said base support.

21. The method of claim 11, wherein said divider track is made of metal.

22. The method of claim 21, wherein said metal is aluminum.

23. The method of claim 11, wherein said divider track further comprises one or more foot assemblies coplanar with said base support and extending on one or both sides of said flanges.

24. A method of joining a molding in a dovetailed joint, comprising;

affixing a divider track to a surface, wherein the divider track has a base support and a pair of flanges extending at a right angle from a front surface of the base support, positioning a wedge shaped spline between and abutting a terminal upper portion of the flanges, positioning a fan shaped mortise, located on a back surface of the molding, over the wedge shaped spline, with the terminal wedge shape spline located between and abutting the upper portion of the flanges, wherein the fan shaped mortise has side walls that extend at an angle from a planar back surface of the molding for making the fan-shaped mortise with its bottom being wider than the opening to the mortise at its top; and applying pressure on a front surface of the molding for seating the molding on the divider track, thereby forcing the wedge shaped spline between the flanges and spreading the flanges, the spread apart flanges engaging side walls of the fan shaped mortise for joining the molding in the dovetailed joint with the divider track.

* * * * *